US011766888B2

(12) United States Patent
Shiao

(10) Patent No.: US 11,766,888 B2
(45) Date of Patent: Sep. 26, 2023

(54) RELEASE FILM TRANSFER PRINTING EQUIPMENT AND OPERATING METHOD THEREOF

(71) Applicant: DAH LIH PUH CO., LTD., Taichung (TW)

(72) Inventor: Jui-Fen Shiao, Taichung (TW)

(73) Assignee: DAH LIH PUH CO., LTD., Taichung (TW)

( * ) Notice: Subject to any disclaimer, the term of this patent is extended or adjusted under 35 U.S.C. 154(b) by 211 days.

(21) Appl. No.: 17/129,834

(22) Filed: Dec. 21, 2020

(65) Prior Publication Data

US 2022/0032605 A1 Feb. 3, 2022

(30) Foreign Application Priority Data

Jul. 29, 2020 (TW) ..... 109209739

(51) Int. Cl.
*B44C 1/17* (2006.01)
*B65C 9/00* (2006.01)

(52) U.S. Cl.
CPC ..... *B44C 1/1733* (2013.01); *B44C 1/1737* (2013.01); *B65C 9/00* (2013.01)

(58) Field of Classification Search
CPC ..... B29C 41/50; B29C 2043/3605; B29C 2043/561; B29C 2045/14155; B29C 2791/006; B41F 16/0053; B41F 16/006; B41F 16/008; B44C 1/1733; B44C 1/1737; B65C 9/00
USPC ..... 156/242, 244.27
See application file for complete search history.

(56) References Cited

U.S. PATENT DOCUMENTS 3,736,200 A * 5/1973 Abilgaard et al. ..... B42B 5/08 264/102
4,059,471 A * 11/1977 Haigh ..... D06P 5/003 156/227
2003/0029553 A1* 2/2003 Toyoda ..... B44C 3/025 156/538

(Continued)

FOREIGN PATENT DOCUMENTS

EP 1367438 A2 * 12/2003 ..... B29C 51/06

OTHER PUBLICATIONS

English translation of EP1367438.*

(Continued)

*Primary Examiner* — Sonya M Sengupta
(74) *Attorney, Agent, or Firm* — CKC & Partners Co., LLC

(57) ABSTRACT

The release film transfer printing equipment is provided. The release film transfer printing equipment includes a machine, a platform, a transfer device and a downward pressing device. The machine has a control panel. The platform is disposed above the machine, and the platform includes a vacuum pump electrically connected to the control panel. The transfer device includes a mold and a release film fixing frame. The mold is disposed above the platform, and the mold includes a plurality of air holes. The release film fixing frame is connected to a periphery of the platform. The downward pressing device is disposed above the transfer device, and the downward pressing device includes a hydraulic cylinder and a downward pressing platform. The hydraulic cylinder is electrically connected to the control panel, and the downward pressing platform is connected to the hydraulic cylinder by a power rod.

8 Claims, 6 Drawing Sheets

(56) References Cited

U.S. PATENT DOCUMENTS

| | | | | |
|---|---|---|---|---|
| 2009/0065130 | A1* | 3/2009 | Fram | B29B 15/122<br>156/244.27 |
| 2022/0032605 | A1* | 2/2022 | Shiao | B41F 16/008 |

OTHER PUBLICATIONS

English translation of JP2000309033.*
English translation of KR20180092209.*
English translation of EP0820878.*
English translation of CN213593918.*
EIC Search Report (Year: 2023).*

* cited by examiner

200

300

400

RELEASE FILM TRANSFER PRINTING EQUIPMENT AND OPERATING METHOD THEREOF

RELATED APPLICATIONS

This application claims priority to Taiwan Application Serial Number 109209739, filed Jul. 29, 2020, which is herein incorporated by reference.

BACKGROUND

Technical Field

The present disclosure relates to a release film transfer printing equipment and an operating method thereof. More particularly, the present disclosure relates to a release film transfer printing equipment and an operating method thereof without heating.

Description of Related Art

Traditionally, adding patterns or colors on the shoe surface is using the digital inkjet machine to complete specific figures or patterns, but the digital inkjet machine is only suitable for flat operation, which will produce poor results for surface with height difference. For example, the farer the distance, the more blurred the figures or patterns are displayed, and also have the concerns about poor productivity.

However, using the release film transfer technology can solve the problem of poor resolution caused by the height difference of the surface. The special ink release film will match according to the appearance of the shoe body. The general release film transfer technology uses the thermal transfer technology to complete the transfer of figures or patterns, but the disadvantage of the thermal transfer technology is that the place where the treatment agent is used will have color difference with the place where the treatment agent is not used.

Therefore, how to overcome the height difference on the shoe body and solve the color difference generated by the thermal transfer treatment agent. Furthermore, it is not necessary to heat during the process so as to reduce electricity costs and have high production capacity, which is the goal of the relevant industry.

SUMMARY

According to one aspect of the present disclosure, a release film transfer printing equipment is provided. The release film transfer printing equipment is for transferring a release film to an object. The release film transfer printing equipment includes a machine, a platform, a transfer device and a downward pressing device. The machine has a control panel. The platform is disposed above the machine, and the platform includes a vacuum pump electrically connected to the control panel. The transfer device includes a mold and a release film fixing frame. The mold is disposed above the platform, and the mold includes a plurality of air holes. The release film fixing frame is connected to a periphery of the platform. The downward pressing device is disposed above the transfer device, and the downward pressing device includes a hydraulic cylinder and a downward pressing platform. The hydraulic cylinder is electrically connected to the control panel, and the downward pressing platform is connected to the hydraulic cylinder by a power rod.

According to another aspect of the present disclosure, an operating method of the release film transfer printing equipment is provided. The operating method of the release film transfer printing equipment includes step as follows. A fixing step is performed, wherein the mold is disposed on the platform, and the release film fixing frame is adjusted to fix the release film. A vacuuming step is performed, wherein the vacuum pump is turned on by using the control panel, so as to the release film is quickly and completely fitted to the mold. A transferring step is performed, wherein the object is correspondingly disposed on the mold, and the downward pressing platform is pushed downward by the hydraulic cylinder, so that the object is attached to the release film of the mold to complete the release film transfer.

According to further another aspect of the present disclosure, a release film transfer printing equipment is provided. The release film transfer printing equipment is for transferring a release film to an object. The release film transfer printing equipment includes a machine, a platform, a transfer device and a downward pressing device. The machine has a control panel. The platform is disposed above the machine. The transfer device includes a release film fixing frame, and the release film fixing frame is connected to a periphery of the platform. The downward pressing device is disposed above the transfer device, and the downward pressing device includes a hydraulic cylinder, a downward pressing platform and a downward pressing element. The hydraulic cylinder is electrically connected to the control panel, and the downward pressing platform is connected to the hydraulic cylinder by a power rod. The downward pressing element is disposed below the downward pressing platform.

According to still another aspect of the present disclosure, an operating method of the release film transfer printing equipment is provided. The operating method of the release film transfer printing equipment includes step as follows. A fixing step is performed, wherein the object is disposed on the platform, and the release film fixing frame is adjusted to fix the release film. A transferring step is performed, wherein the downward pressing platform is pushed downward by the hydraulic cylinder and the downward pressing element is moved with the downward pressing platform to press the release film, so that the release film is attached to the object to complete the release film transfer.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
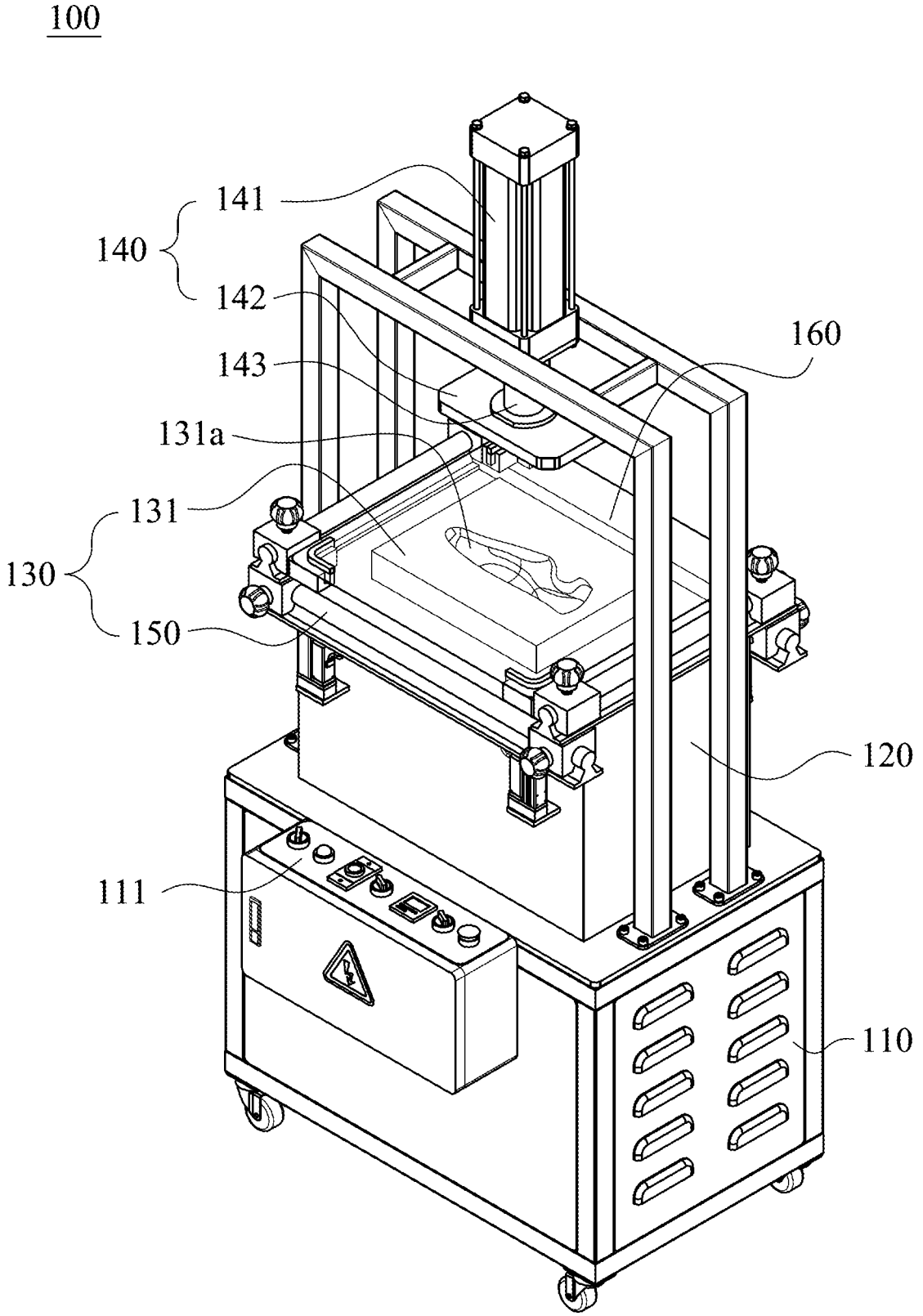
FIG. 1 is a three-dimensional schematic view of a release film transfer printing equipment according to one embodiment of the present disclosure.

The present disclosure will be further exemplified by the following specific embodiments along drawings thereof so as to facilitate utilizing and practicing the present disclosure completely by the people skilled in the art without over-interpreting and over-experimenting. However, the readers should understand that the present disclosure should not be limited to these practical details thereof, that is, in some embodiments, these practical details are used to describe how to implement the materials and methods of the present disclosure and are not necessary. Furthermore, in order to simplify the drawings, some conventional structures and elements will be illustrated in a simple manner in the drawings, and the repeated elements may be represented by the same reference numerals.

Please refer to FIG. 1, which is a three-dimensional schematic view of a release film transfer printing equipment 100 according to one embodiment of the present disclosure. As shown in FIG. 1, the release film transfer printing equipment 100 includes a machine 110, a platform 120, a transfer device 130 and a downward pressing device 140.

Specifically, the machine 110 has a control panel 111, the platform 120 is disposed above the machine 110, and the platform 120 includes a vacuum pump (not shown), the vacuum pump is electrically connected to the control panel 111. The transfer device 130 includes a mold 131 and a release film fixing frame 150. The mold 131 is disposed above the platform 120, and the mold 131 includes a plurality of air holes (not shown). The release film fixing frame 150 is connected to a periphery of the platform 120. The downward pressing device 140 is disposed above the transfer device 130, and the downward pressing device 140 includes a hydraulic cylinder 141 and a downward pressing platform 142. The hydraulic cylinder 141 is electrically connected to the control panel 111. The downward pressing platform 142 is connected to the hydraulic cylinder 141 by a power rod 143. Therefore, the release film transfer printing equipment 100 can transfer a release film 160 to an object (not shown).

Figure 2:
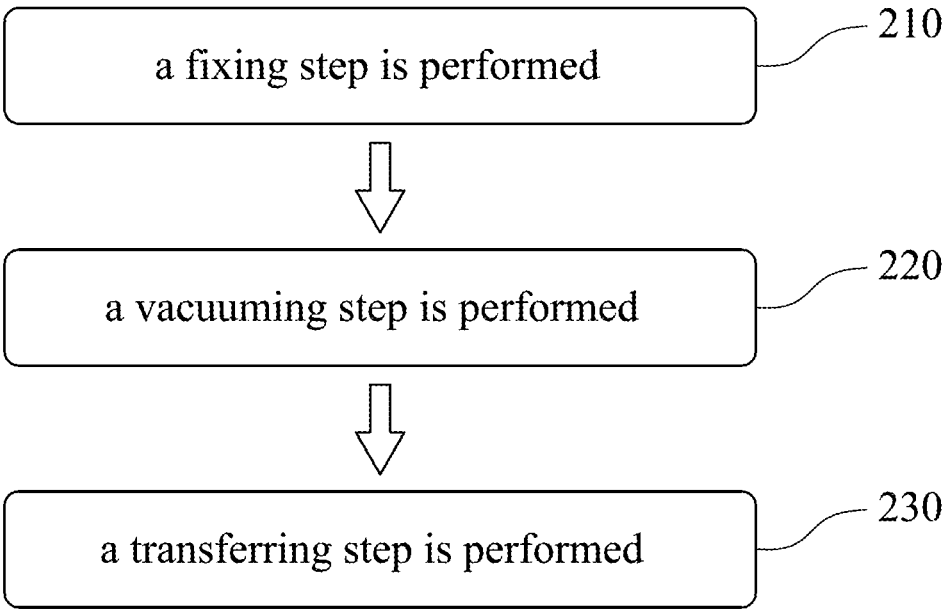
FIG. 2 is an operating method of the release film transfer printing equipment according to another embodiment of the present disclosure.

Please refer to FIG. 2, which is an operating method of the release film transfer printing equipment 200 according to another embodiment of the present disclosure. The operating method of the release film transfer printing equipment 200 includes a step 210, a step 220 and a step 230.

In the step 210, a fixing step is performed, wherein the mold 131 is disposed on the platform 120, and the release film fixing frame 150 is adjusted to fix the release film 160. Specifically, first, the mold 131 is disposed on the platform 120, wherein the mold 131 is made of an aluminum metal material, and a surface 131*a* of the mold 131 is designed according to a curved surface structure of the object. For example, the object can be but not limited to a shoe body, and the surface 131*a* of the mold 131 can be designed according to an upper or a sole of the shoe body. Next, the special ink of the figures or patterns to be transferred is screen-printed on the release film 160, and fixing the release film 160 to the release film fixing frame 150. The release film 160 is straightened and fixed on a proper position by adjusting the height or length and width of the release film fixing frame 150. The height is adjusted according to the height of the mold 131, and the length and width are adjusted according to the size of the release film 160.

In the step 220, a vacuuming step is performed, wherein the vacuum pump is turned on by using the control panel 111, so that the release film 160 is quickly and completely fitted to the mold 131. Specially, the vacuum pump is turned on by the control panel 111, and the release film 160 is adsorbed on the mold 131. A surface of the platform 120 contacted the mold 131 also has a plurality of through holes (not shown), so that the air holes of the mold 131 will be combined with the through holes of the platform 120 to form a vacuum flow channel (not shown). Therefore, when the release film transfer printing equipment 100 performs the step 220, the release film 160 will quickly and completely fit to the surface 131*a* of the mold 131, so that the release film 160 fits the mold 131 more closely, and then the object is disposed on the mold 131 correspondingly. However, before placing the object, it is necessary to confirm whether the release film 160 is adsorbed on the mold 131.

In the step 230, a transferring step is performed, wherein the object is correspondingly disposed on the mold 131, and the downward pressing platform 142 is pushed downward by the hydraulic cylinder 141, so that the object is attached to the release film 160 of the mold 131 to complete the release film 160 transfer. Specifically, the hydraulic cylinder 141 is turned on by the control panel 111, and the power rod 143 is moved by the hydraulic cylinder 141 to push the downward pressing platform 142 downward, so that the object and the release film 160 on the mold 131 show better compliance to achieve seamlessly bonding as a whole. The maximum upper limit pressure of the hydraulic cylinder 141 is 50 kg, and the pressure of the hydraulic cylinder 141 can be adjusted according to the object to be transferred. Finally, the downward pressing platform 142 is retracted, and the transfer is completed by taking the transferred object.

Figure 3:
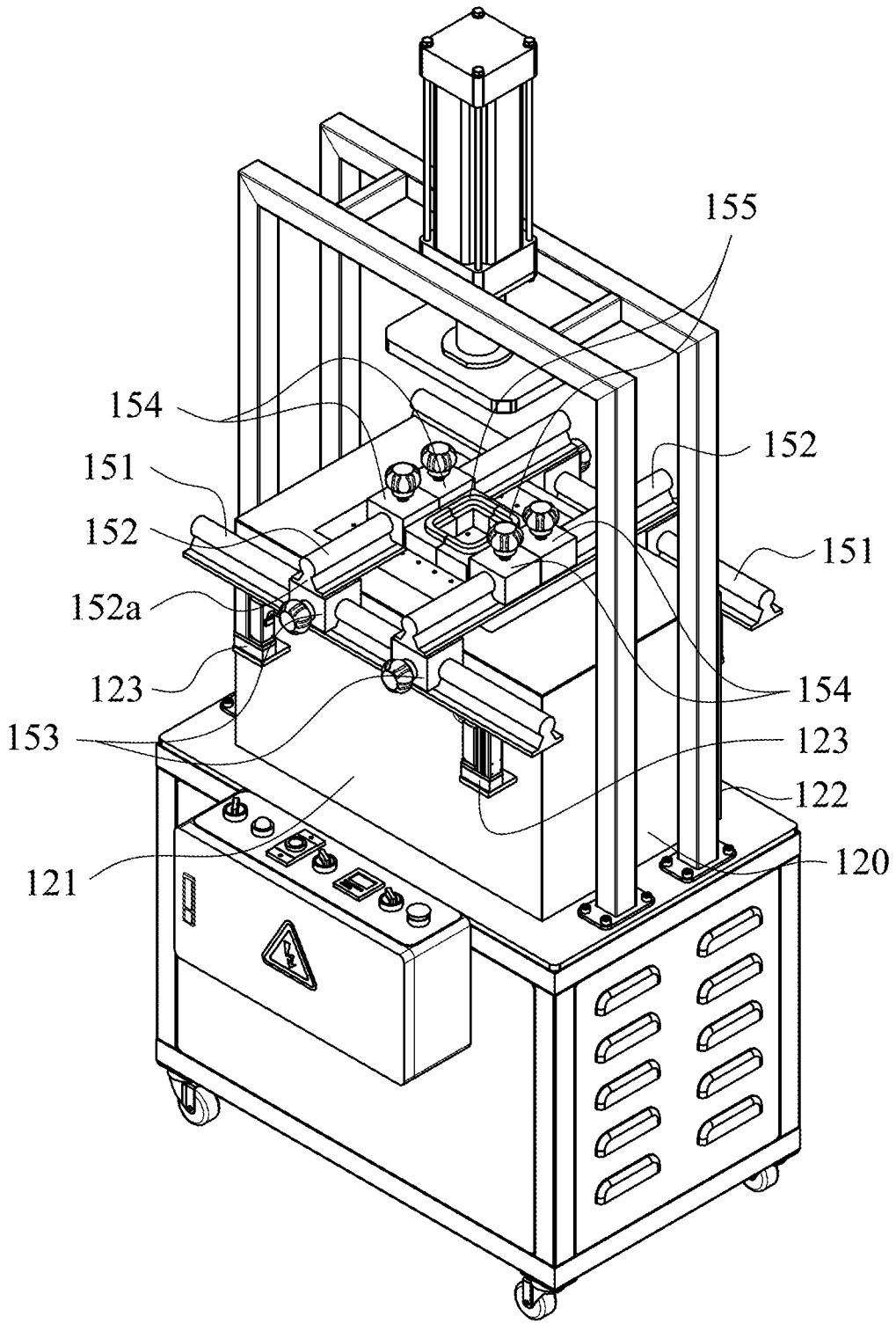
FIG. 3 is a schematic diagram of an adjusted state of the release film fixing frame of the release film transfer printing equipment as shown in FIG. 1.
Figure 4:
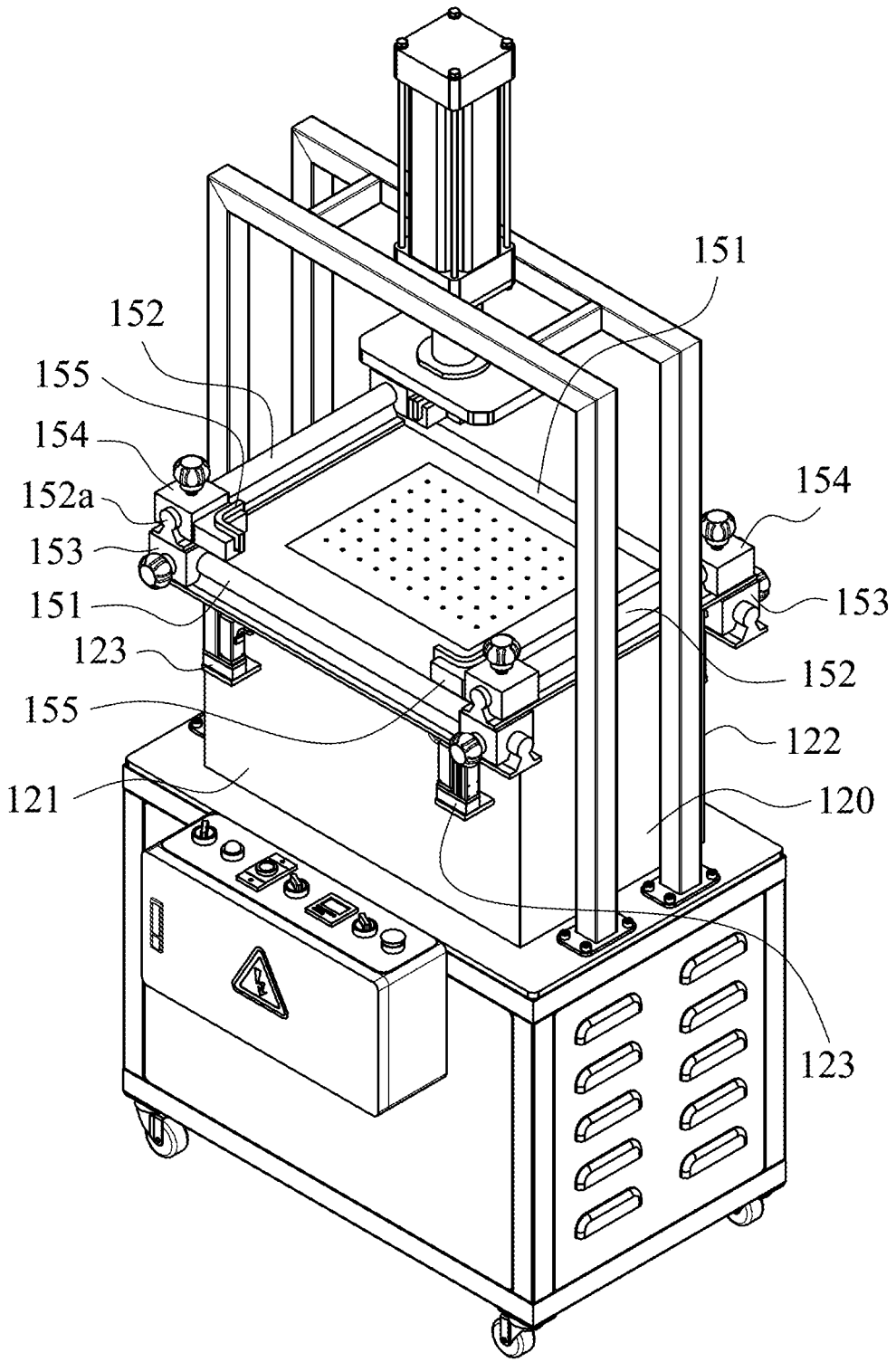
FIG. 4 is a schematic diagram of another adjusted state of the release film fixing frame of the release film transfer printing equipment as shown in FIG. 1.

Please refer to FIG. 3 and FIG. 4. FIG. 3 is a schematic diagram of an adjusted state of the release film fixing frame 150 of the release film transfer printing equipment 100 as shown in FIG. 1. FIG. 4 is a schematic diagram of another adjusted state of the release film fixing frame 150 of the release film transfer printing equipment 100 as shown in FIG. 1.

Specifically, in the embodiment of FIG. 3, and FIG. 4, the platform 120 has a first side 121 and a second side 122 opposite to each other, and the first side 121 and the second side 122 include at least two fixing frame raising devices 123, respectively. Moreover, the release film fixing frame 150 includes two fixed slide rails 151 and two moving slide rails 152. The two fixed slide rails 151 are fixed on the first side 121 and the second side 122 of the platform 120, respectively, and connected to the at least two fixing frame raising devices 123, respectively. Each of the two moving slide rails 152 includes two first sliding devices 153, and the two first sliding devices 153 of each of the two moving slide rails 152 are disposed on two ends 152*a* of each of the two moving slide rails 152, respectively, and connected to the two fixed slide rails 151, respectively. Furthermore, the release film fixing frame 150 further includes four second sliding devices 154 and four corner frames 155. Two of the four second sliding devices 154 are connected to one of the two moving slide rails 152, and each of the four corner frames 155 is connected to each of the four second sliding devices 154.

In the embodiment of FIG. 3 and FIG. 4, when adjusting the release film fixing frame 150, the moving slide rails 152 is sliding on the fixed slide rail 151 by moving the first sliding device 153, so as to meet the length of the release film 160. Next, the corner frame 155 is sliding on the moving slide rail 152 by moving the second sliding device 154, so as to meet the width of the release film 160, and the four corners of the release film 160 are fixed by the four corner frames 155. Then, the fixing frame raising device 123 can be adjusted according to the height of the mold 131 to complete the fixing step of the release film 160.

Therefore, after the release film transfer printing equipment 100 performing the vacuuming step, the release film 160 is quickly and completely fitted to the mold 131 with the vacuum flow channel formed by the air holes of the mold 131 and the through holes of the platform 120. Then, the object is attached to the release film 160 by the downward pressing platform 142 to complete the transfer, and the release film transfer printing equipment 100 of the present disclosure can transfer without any heating step or according to the room temperature.

Figure 5:
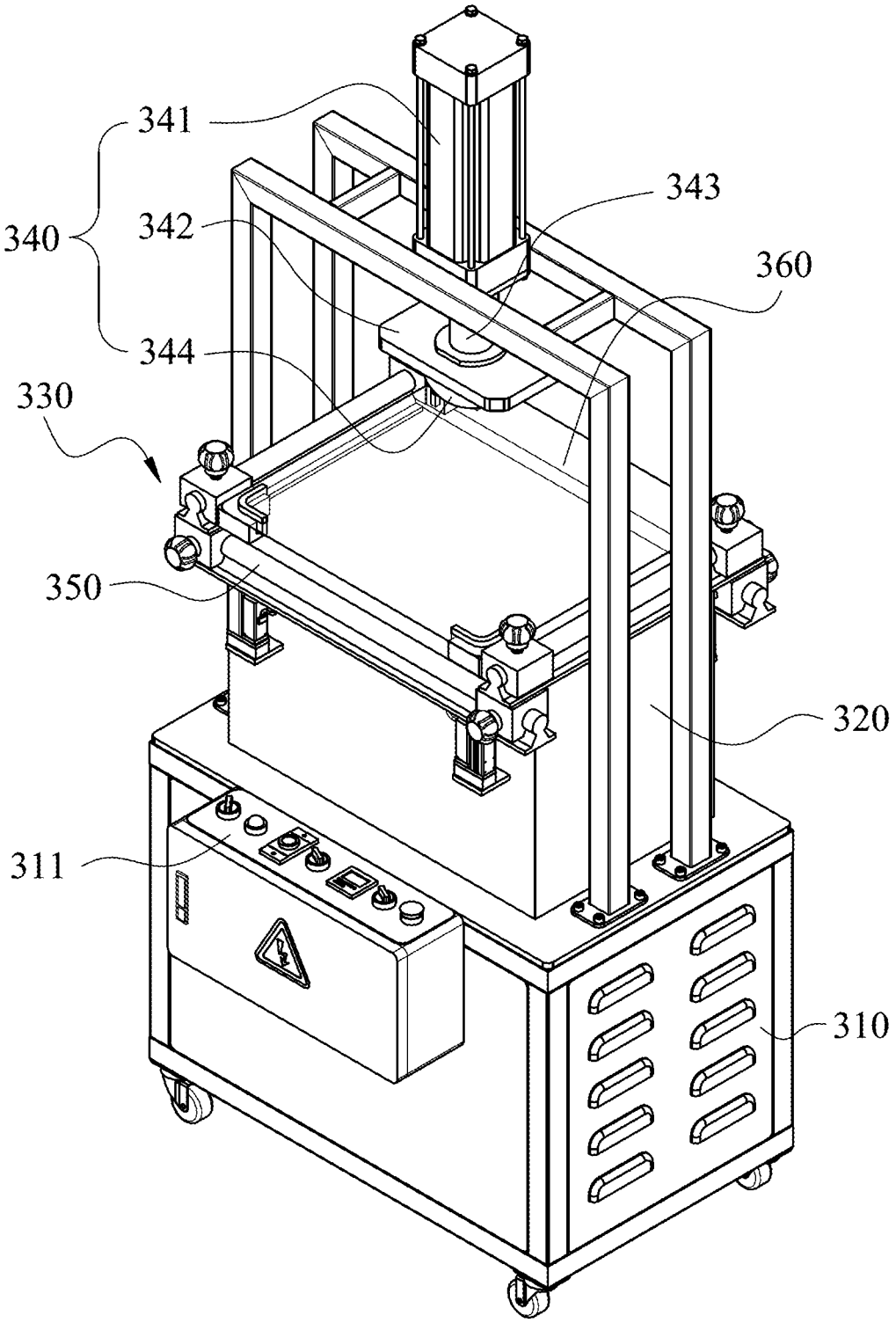
FIG. 5 is a three-dimensional schematic view of a release film transfer printing equipment according to further another embodiment of the present disclosure.

Please refer to FIG. 5, which is a three-dimensional schematic view of a release film transfer printing equipment 300 according to further another embodiment of the present disclosure. As shown in FIG. 5, the release film transfer printing equipment 300 includes a machine 310, a platform 320, a transfer device 330 and a downward pressing device 340.

Specifically, the machine 310 has a control panel 311, the platform 320 is disposed above the machine 310. The transfer device 330 includes a release film fixing frame 350, which is connected to a periphery of the platform 320. The downward pressing device 340 is disposed above the transfer device 330, and the downward pressing device 340 includes a hydraulic cylinder 341, a downward pressing platform 342 and a downward pressing element 344. The hydraulic cylinder 341 is electrically connected to the control panel 311. The downward pressing platform 342 is connected to the hydraulic cylinder 341 by a power rod 343. The downward pressing element 344 is disposed below the downward pressing platform 342. Therefore, the release film transfer printing equipment 300 can transfer a release film 360 to an object (not shown).

Figure 6:
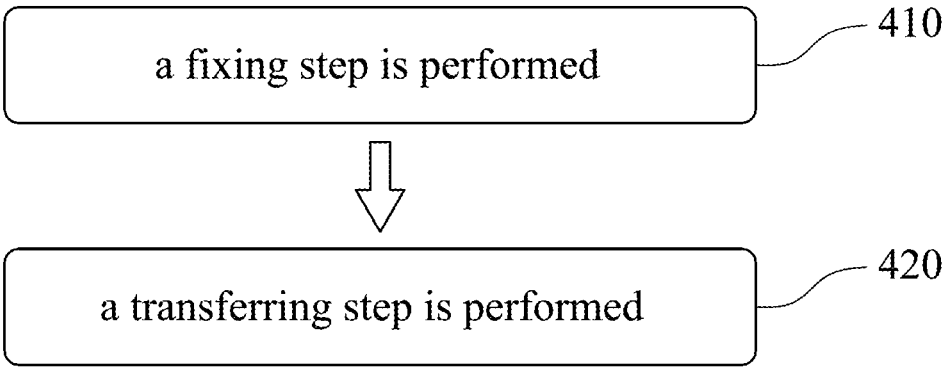
FIG. 6 is an operating method of the release film transfer printing equipment according to still another embodiment of the present disclosure.

Please refer to FIG. 6, which is an operating method of the release film transfer printing equipment 400 according to still another embodiment of the present disclosure. The operating method of the release film transfer printing equipment 400 includes a step 410 and a step 420.

In the step 410, a fixing step is performed, wherein the object is disposed on the platform 320, and the release film fixing frame 350 is adjusted to fix the release film 360. Specifically, first, the object to be transferred is disposed on the platform 320, and the object can be but not limited to the shoe uppers, the shoe soles or the finished products as shoes. Next, the special ink of the figures or patterns to be transferred is screen-printed on the release film 360, and fixing the release film 360 to the release film fixing frame 350. The release film 360 is straightened and fixed on a proper position by adjusting the height or length and width of the release film fixing frame 350. The height is adjusted according to the height of the object, and the length and width are adjusted according to the size of the release film 360.

In the step 420, a transferring step is performed, wherein the downward pressing platform 342 is pushed downward by the hydraulic cylinder 341 and the downward pressing element 344 is moved with the downward pressing platform 342 to press the release film 360, so that the release film 360 is attached to the object to complete the release film transfer. Specifically, the hydraulic cylinder 341 is turned on by the control panel 311, and the power rod 343 is moved by the hydraulic cylinder 341 to push the downward pressing platform 342 downward. Then, the downward pressing element 344 is moved to press the release film 360, so that the release film 360 and the object show better compliance. The downward pressing element 344 is made of a special composite material, and the special composite material has the characteristics of slow rebound, high replication ability, repeated use, weather resistance and temperature resistance, such as the composite special memory material. Therefore, the downward pressing element 344 will change according to the shape of the object to be transferred, so that the release film 360 and the object show better compliance to achieve seamlessly bonding as a whole. Furthermore, the maximum upper limit pressure of the hydraulic cylinder 341 is 50 kg, and the pressure of the hydraulic cylinder 341 can be adjusted according to the object to be transferred. Finally, the downward pressing platform 342 is retracted, and the transfer is completed by taking the transferred object.

Regarding to the adjustment method of the release film fixing frame 350 of the release film transfer printing equipment 300 of FIG. 5, please refer to the adjustment method of the release film fixing frame 150 of FIG. 3 and FIG. 4, and it will not be described herein.

Therefore, the downward pressing element 344 made of the special composite material of the release film transfer printing equipment 300 of the present disclosure can change with the shape of the object according to the characteristics of the special composite material. When the downward pressing element 344 presses the release film 360, the release film 360 will be closely attached to the object to complete the transfer, and the release film transfer printing equipment 300 of the present disclosure can transfer without any heating step or according to the room temperature.

In conclusion, the release film transfer printing equipment of the present disclosure can make the release film attach to the object closely by the vacuum method or the downward pressing element with the special composite material, so as to overcome the problem of poor display of the figures or patterns caused by the height difference of the object. Furthermore, the release film transfer printing equipment of the present disclosure can transfer without any heating step or affected by the room temperature. It can solve the problem of color difference generated by the thermal transfer treatment agent, so as to increase faster production capacity and enhance the competitiveness of enterprises.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A release film transfer printing equipment, which is for transferring a release film to an object, the release film transfer printing equipment comprising:
- a machine having a control panel;
- a platform disposed above the machine, and the platform comprising a vacuum pump electrically connected to the control panel;
- a transfer device, comprising:
  - a mold disposed above the platform, and the mold comprising a plurality of air holes; and
  - a release film fixing frame connected to a periphery of the platform; and a downward pressing device disposed above the transfer device, and the downward pressing device comprising:

a hydraulic cylinder electrically connected to the control panel; and a downward pressing platform connected to the hydraulic cylinder by a power rod.

2. The release film transfer printing equipment of claim 1, wherein the platform has a first side and a second side opposite to each other, and the first side and the second side comprise at least two fixing frame raising devices, respectively.

3. The release film transfer printing equipment of claim 2, wherein the release film fixing frame comprises:

two fixed slide rails, wherein the two fixed slide rails are fixed on the first side and the second side of the platform, respectively, and connected to the at least two fixing frame raising devices, respectively; and two moving slide rails, wherein each of the two moving slide rails comprises two first sliding devices, and the two first sliding devices of each of the two moving slide rails are disposed on two ends of each of the two moving slide rails, respectively, and connected to the two fixed slide rails, respectively.

4. The release film transfer printing equipment of claim 3, wherein the release film fixing frame comprises:

four second sliding devices, wherein two of the four second sliding devices are connected to one of the two moving slide rails; and four corner frames, each of the four corner frames is connected to each of the four second sliding devices.

5. The release film transfer printing equipment of claim 1, wherein the air holes of the mold are combined with the platform to form a vacuum flow channel.

6. The release film transfer printing equipment of claim 5, wherein the mold is made of an aluminum metal material, and a surface of the mold is designed according to a curved surface structure of the object.

7. An operating method of a release film transfer printing equipment, comprising:

providing the release film transfer printing equipment, wherein the release film transfer printing equipment is for transferring a release film to an object, and comprises:

a machine having a control panel;

a platform disposed above the machine, and the platform comprising a vacuum pump electrically connected to the control panel;

a transfer device, comprising:

a mold disposed above the platform, and the mold comprising a plurality of air holes; and a release film fixing frame connected to a periphery of the platform; and a downward pressing device disposed above the transfer device, and the downward pressing device comprising:

a hydraulic cylinder electrically connected to the control panel; and a downward pressing platform connected to the hydraulic cylinder by a power rod;

performing a fixing step, wherein the mold is disposed on the platform, and the release film fixing frame is adjusted to fix the release film;

performing a vacuuming step, wherein the vacuum pump is turned on by using the control panel, so that the release film is quickly and completely fitted to the mold; and performing a transferring step, wherein the object is correspondingly disposed on the mold, and the downward pressing platform is pushed downward by the hydraulic cylinder, so that the object is attached to the release film of the mold to complete the release film transfer.

8. The operating method of the release film transfer printing equipment of claim 7, wherein the release film transfer printing equipment can transfer without any heating step or according to the room temperature.

* * * * *